US011946717B1

(12) United States Patent
Speirs et al.

(10) Patent No.: US 11,946,717 B1
(45) Date of Patent: Apr. 2, 2024

(54) PRESSURIZED GAS LAUNCHER

(71) Applicant: The United States of America as represented by the Secretary of the Navy, Newport, RI (US)

(72) Inventors: Nathan B Speirs, Newport, RI (US); Jesse L Belden, Dighton, MA (US); Aren M Hellum, Wakefield, RI (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 17/949,505

(22) Filed: Sep. 21, 2022

(51) Int. Cl.

| | |
|---|---|
| ***F41B 11/723*** | (2013.01) |
| ***F41B 11/62*** | (2013.01) |
| ***F41B 11/681*** | (2013.01) |
| ***F41F 3/08*** | (2006.01) |

(52) U.S. Cl.
CPC ..... *F41B 11/723* (2013.01); *F41B 11/62* (2013.01); *F41B 11/681* (2013.01); *F41F 3/08* (2013.01)

(58) Field of Classification Search
CPC ..... F41B 11/723; F41B 11/62; F41B 11/681; F41F 3/00; F41F 3/08; F41F 3/10; F41A 23/22
See application file for complete search history.

(56) References Cited

U.S. PATENT DOCUMENTS

| | | | | | |
|---|---|---|---|---|---|
| 4,159,705 | A * | 7/1979 | Jacoby | F41B 11/66 | 124/63 |
| 5,200,572 | A * | 4/1993 | Bissonnette | F41F 3/10 | 114/238 |
| 5,373,832 | A * | 12/1994 | D'Andrade | F41B 11/68 | 124/59 |
| 5,373,833 | A * | 12/1994 | D'Andrade | F41B 11/00 | 124/73 |
| 6,279,562 | B1 * | 8/2001 | Clayton | F41B 9/0018 | 124/59 |
| 6,382,123 | B1 * | 5/2002 | Grondin | F41F 3/08 | 114/319 |
| 8,240,610 | B1 * | 8/2012 | Cooper | A41D 13/0155 | 2/2.14 |
| 2010/0018724 | A1 * | 1/2010 | Cleary | A62C 8/005 | 169/53 |

FOREIGN PATENT DOCUMENTS

| | | | | |
|---|---|---|---|---|
| DE | 102012206709 | * 10/2013 | F41F 3/10 | |
| EP | 2107331 | * 10/2009 | F41F 3/10 | |
| KR | 20160028746 | * 3/2016 | F41F 3/08 | |

* cited by examiner

*Primary Examiner* — John E Simms, Jr.
(74) *Attorney, Agent, or Firm* — James M. Kasischke; Michael P. Stanley; Jeffry C. Severson

(57) ABSTRACT

Methods and systems are provided for a pressurized gas launcher. The pressurized gas launcher includes a pressure source providing a quantity of high-pressure gas, a launcher barrel having a first end and a second end having an opening, and a bladder. The bladder is housed within the launcher barrel and selectively fluidically coupled to the pressure source. When filled with pressurized gas, the bladder plastically deforms. The gas launcher further includes a projectile housed within the launcher barrel with the bladder positioned between the first end of the launcher barrel and the projectile. The projectile is dischargeable from the launcher barrel when the bladder ruptures when gas in the bladder exceeds a pressure threshold.

12 Claims, 3 Drawing Sheets

PRESSURIZED GAS LAUNCHER

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The invention relates to a projectile launcher, and more particularly to a projectile launcher having enhanced launch speed.

(2) Description of the Related Art

A class of single-use projectile launchers includes pressurized gas launchers. Pressurized gas launchers rapidly accelerate a projectile to a high initial velocity using expanding gas. Pressurized gas launchers may be desirable for launching a projectile when explosives, fuels, electromagnetic or mechanical means are not feasible. Typical pressurized gas launcher designs include a pressure vessel containing compressed gas coupled to a barrel via an orifice such as a flow-restricting valve. Operating the valve rapidly opens the connection between compressed gas and the barrel in which the projectile is placed.

FIG. 1 depicts a prior art pressurized gas launcher 1 comprising a pressure vessel 6 and a barrel 2 connected via an orifice 3. A projectile 5 is placed within barrel 2 that is launched by opening a valve 4, such as a dump valve, positioned in the orifice 3, thereby fluidly coupling the barrel 2 and pressure vessel 6. Compressed gas in the pressure vessel 6, initially at pressure $P_0$, is discharged through orifice 3 into the barrel 2. The projectile 5 exits an opening of the barrel 2 in the direction A. The projectile 5 accelerates according to as:

$$a(t)=P(t)A/m \tag{1}$$

where m is the projectile mass, A is the cross-sectional area of the projectile on which the barrel pressure acts, and P(t) is the pressure acting on the back of the projectile. P(t) is a decaying function of time.

The dump valve 4 rapidly opens the connection between the barrel 2 and the pressure vessel 6, such that the connection may be modeled as an orifice. The orifice 3 constricts the air flow from the pressure vessel 6 to the barrel resulting in two main effects on the operation of the launcher 1. First, the orifice 3 induces a pressure drop resulting in a barrel pressure that is lower than the vessel pressure. Second, in the case in which the 2 barrel diameter is larger than the orifice 3 diameter, the contraction-expansion condition creates a potential for flow to choke. The flow chokes when the velocity of the gas in the orifice 3 reaches the local speed of sound c, which limits the barrel velocity as follows:

$$U_{choked} = c\frac{A_{orifice}\rho_{orifice}}{A_{barrel}\rho_{barrel}} \tag{2}$$

where $A_{orifice}$ is the cross-sectional area of the orifice, $\rho_{orifice}$ is the gas density at the orifice, $A_{barrel}$ is the cross-sectional area of the barrel and $\rho_{barrel}$ is the gas density in the barrel. Choked flow limits the maximum mass flow rate, and thus caps the maximum exit velocity of the projectile.

Considering the choked flow condition as an upper bound on the velocity, the exit velocity of the projectile can be described as follows:

$$U_e = \min\left\{\left[\frac{A}{m}\int_0^L P(s)ds\right]^{1/2},\ U_{choked}\right\} \tag{3}$$

Therefore, with consideration of Equation (3), the exit velocity of the projectile 5 may be increased in a few ways. The projectile 5 mass m may be reduced. The cross-sectional area A of the projectile may be increased. However, adjusting the size of the projectile may not be desirable or feasible in some circumstances. The length L as shown in FIG. 1, of the barrel 2 may be increased. However, the space constraint for single-use launcher operation may be a consideration. The vessel pressure $P_0$ may be increased, resulting in a larger magnitude of P(t) so long as the flow does not choke. The diameter of the orifice 3 may be increased such that the flow chokes at a larger velocity and the pressure drop over the orifice 3 is reduced. Given that it may not be desirable to adjust the size of the projectile 5 or increase the length L of the barrel 2, a need exists for a pressurized gas launcher which can minimize the effects of pressure drop and choke.

SUMMARY OF INVENTION

It is therefore a primary object and general purpose of the present invention to provide a pressurized gas launcher capable of launching a fixed-size projectile at high exit velocity without increasing the length of the launcher barrel.

The pressurized gas launcher generally comprises a pressure source providing a quantity of high-pressure gas, a launcher barrel having a first end and a second end having an opening. A bladder is housed within the launcher barrel and is selectively, fluidically coupled to the pressure source. The bladder plastically deforms at a predetermined fill pressure. A projectile is also housed within the launcher barrel. The bladder is positioned between the first end of the launcher barrel and the projectile. Rupturing of high pressure gas from the bladder causes discharge of the projectile via an opening in the second end of the launcher barrel.

When the bladder ruptures, the ruptured area of the bladder has a large effective cross-sectional area, minimizing airflow constriction and pressure differential in the launcher barrel, and increasing the projectile exit velocity. The disclosed apparatus has the additional benefit that bladder material properties may be tailored to a specific application. For example, by forming the bladder from more or less compliant and more or less frangible materials, the bladder may be designed to rupture at a target pressure level. As another example, a bladder size at rupture may also be adjusted based on material selection. Moreover, modifications such as scoring the bladder material may cause a fracture pattern that maximizes area of breakage.

The pressurized gas launcher can be used to launch a projectile to a high exit velocity using compressed gas including in circumstances when explosives, fuels, electromagnetic or mechanical means are not feasible and where space is limited.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

Features of illustrative embodiments may be understood from the accompanying drawings in conjunction with the description. The elements in the drawings may not be drawn to scale. Some elements and/or dimensions may be enlarged or minimized for the purpose of illustration and understanding of the disclosed embodiments.

DETAILED DESCRIPTION OF THE INVENTION

Figure 1:
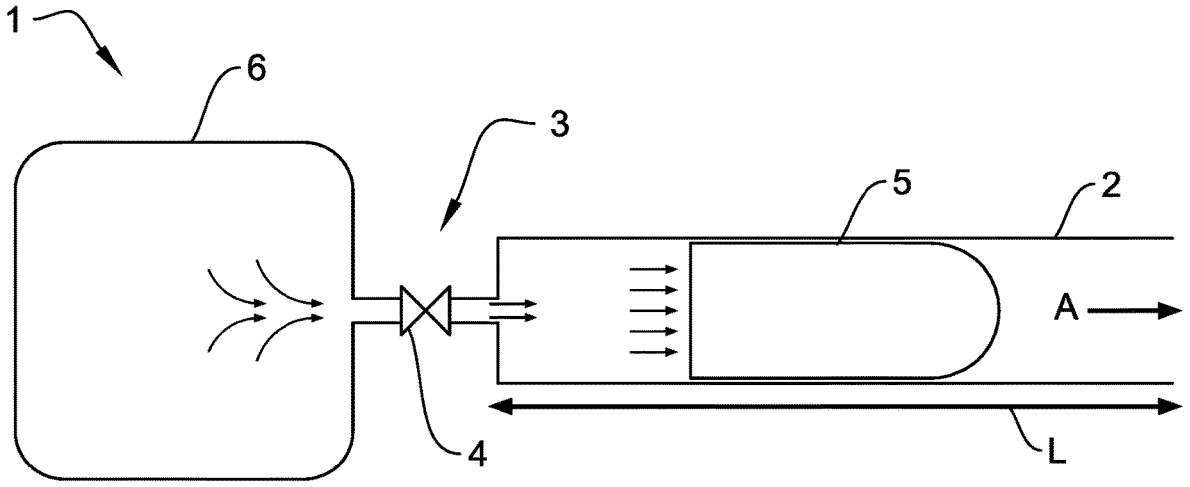
FIG. 1 (PRIOR ART)
FIG. 1 is a prior art depiction of a pressurized gas launcher for which air flow and pressure dynamics are described.
Figure 2A:
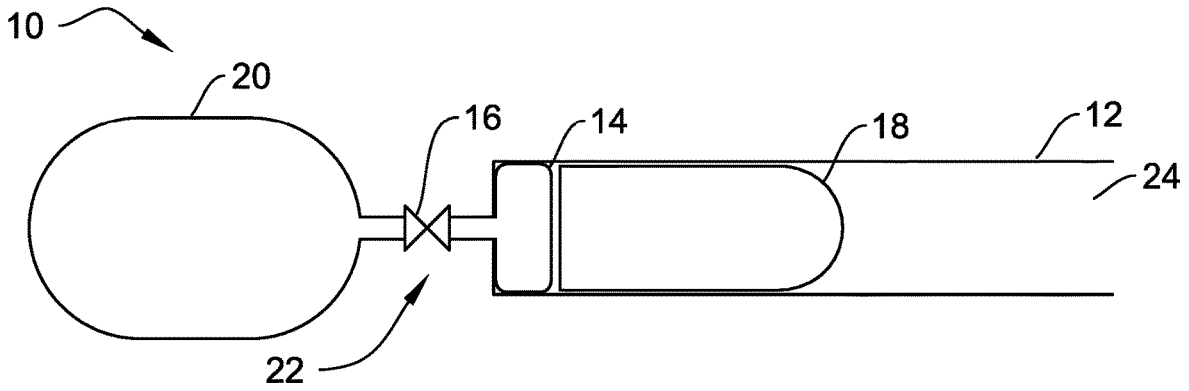
FIG. 2A is a schematic illustration of a pressurized gas launcher before launch.
Figure 2B:
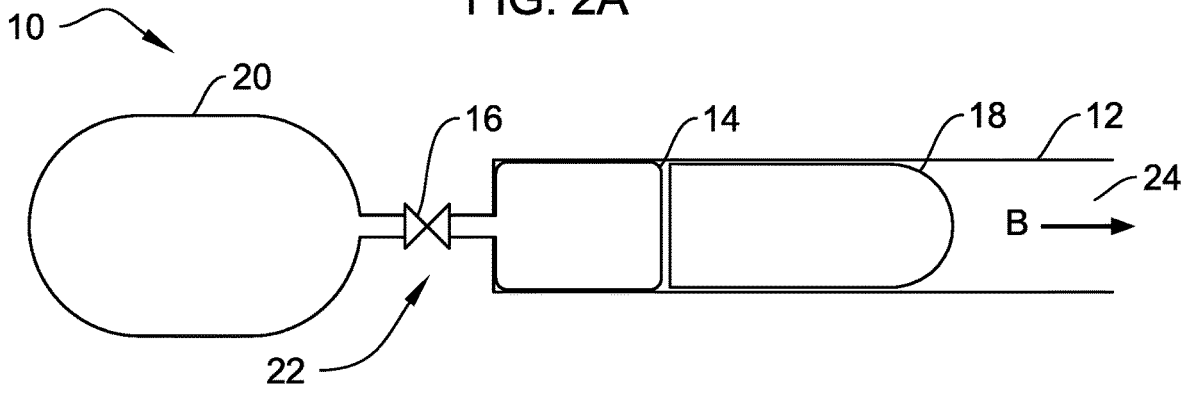
FIG. 2B is a schematic illustration of a pressurized gas launcher during launch.
Figure 2C:
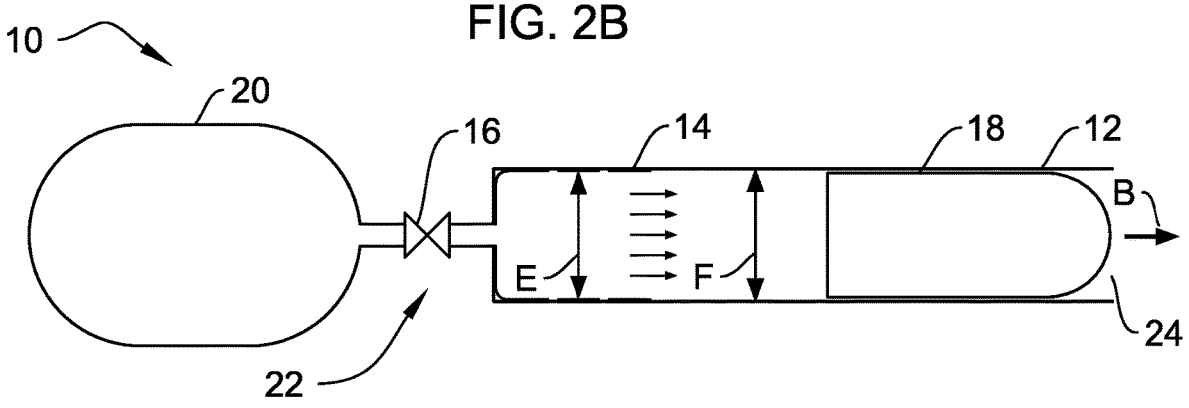
FIG. 2C is a schematic illustration of a pressurized gas launcher after bladder rupture.
Figure 3A:
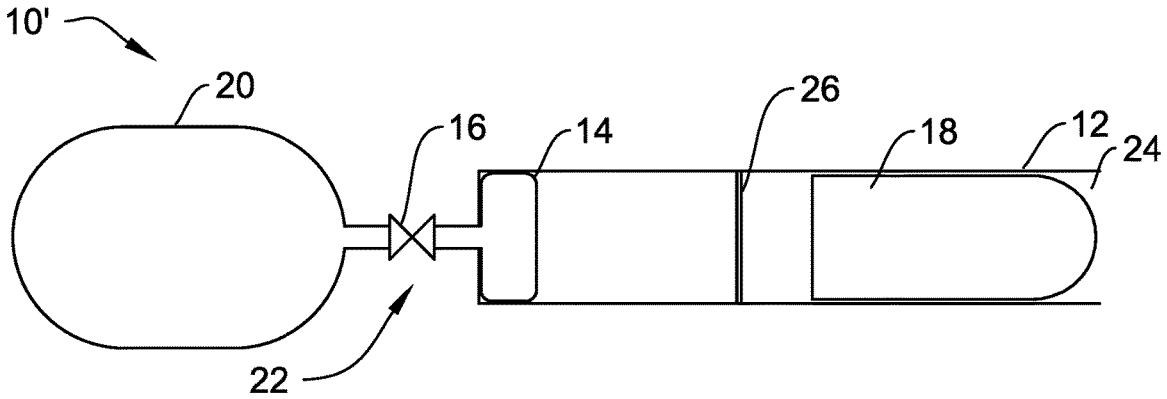
FIG. 3A is a schematic illustration of a pressurized gas launcher in accordance with a second embodiment before launch.
Figure 3B:
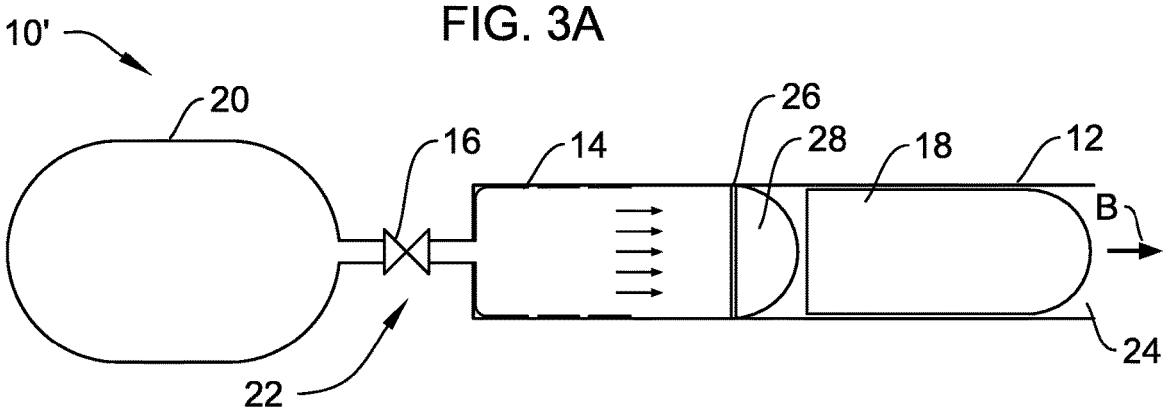
FIG. 3B is a schematic illustration of a pressurized gas launcher in accordance with a second embodiment after bladder rupture.

The pressurized gas launcher, including a compliant but frangible bladder, is shown in FIGS. 2A, 2B, and 2C. An alternative embodiment is shown in FIGS. 3A and 3B.

FIG. 2A depicts an example of the launcher 10 before a launch operation. FIG. 2B depicts the same launcher during launch, and FIG. 2C depicts the launcher after bladder 14 rupture for single-use discharge of a projectile 18. The launcher 10 includes a pressure source 20. The launcher 10 includes a bladder 14 and a fill valve 16. The launcher 10 includes a launcher barrel 12 having a first end 22 or breech end, and a second end 24 or exit end having an opening. The bladder 14 is housed within launcher barrel 12 positioned to abut the first end 22 of the launcher barrel 12 on the valve side and to abut the projectile 18 on the projectile side. The pressure vessel 20 is positioned adjacent to the bladder 14. The fill valve 16 is positioned between and in fluidic communication between the pressure vessel 20 and the bladder 14.

The launcher barrel 12 is not in fluidic communication with the pressure vessel 20. In one example, the pressure source is a pressure vessel 20; however, the pressure source could be a high pressure environment or a compressor. A compressor can provide a relatively low volume of high pressure gas in bladder 14 until the critical pressure is achieved. In some examples, the launcher barrel 12 is cylindrical and in other examples, the launcher barrel 12 is another shape. In some examples, the breech end of the launcher barrel 12 is coupled to the pressure vessel 20 and in other examples the pressure source passes through the launcher barrel 12 side wall into the bladder 14.

The bladder 14 comprises a bladder wall formed from a material designed to expand in response to increasing pressure and to undergo plastic deformation at a predetermined fill pressure. Plastic deformation causes the bladder to burst open and rapidly evacuate the high pressure gas inside. The sudden pressure increase propels the projectile 18 out of the barrel. In other words, the projectile 18 is discharged from the launcher barrel 12 out of the opening in the second end 24 by high pressure gas rupturing from the bladder 14. Upon rupturing, the material forming the bladder 14 provides little or no flow restriction, and thus the choking and pressure loss effects normally associated with an orifice are avoided.

The bladder material is preferably made from a material that plastically deforms at a threshold stress amount. The bladder may alternatively be made from a material that plastically deforms at a threshold strain rate. As a few preferred examples, the bladder 14 may be formed from a polymer, an elastomer, a visco-plastic, or other similar materials. In one example, the bladder 14 may be scored or modified in some other manner to achieve a fracture pattern or rupture pattern that is desirable to maximize an area of breakage. For example, inner or outer surfaces of the bladder 14 may have score marks patterned to cause initial rupture at a desired position of the bladder, such as on a surface facing the projectile 18.

Prior to launch operation as shown in FIG. 2A, the fill valve 16 is closed. The air pressure within the pressure vessel 20 is high. The air pressure within the bladder 14 is lower than the air pressure within the pressure vessel 20.

During launch operation as shown in FIG. 2B, the fill valve 16 is opened. Opening the fill valve 16 establishes fluidic communication between the pressure vessel 20 and the bladder 14. The compressed gas, having been contained at higher pressure within pressure vessel 20, flows into the bladder 14. The bladder 14 (e.g., the bladder wall) expands as it is filled with high pressure gas. As the bladder 14 expands, the projectile 18 can be moved laterally within the launcher barrel 12 in direction B. The stress in the bladder material increases with the rising internal pressure within the bladder 14.

During launch operation as shown in FIG. 2C, the bladder 14 pressure increases greater than the threshold stress amount, or first threshold pressure, causing the bladder 14 to rupture. The rupture rapidly releases the high pressure gas with minimal flow restriction. Pressure drop and flow choking are negligible due to the diameter F of the launcher barrel 12 and diameter E of bladder 14 being approximately equal, and therefore minimizing the air expansion and contraction associated with compressed air flowing through an orifice. In other words, the ruptured area of the bladder 14 has a larger effective cross-sectional area than a control valve, such as described with respect to the prior art.

FIGS. 3A and 3B depict an example of the launcher 10' including an additional launcher valve 26. The embodiment is shown before a launch operation in FIG. 3A and during a launch operation in FIG. 3B. The launcher 10' includes the elements described with respect to FIGS. 2A, 2B, and 2C including the pressure vessel 20, the launcher barrel 12, the bladder 14, and the fill valve 16. The launcher barrel 12 includes the first end 22 and the second end 24 having an opening wherefrom the launching projectile exits. The launcher barrel 12 is not in fluidic communication with the pressure vessel 20.

The launcher valve 26 is mounted inside the launcher barrel 12 and positioned between the projectile 18 and the bladder 14. Hinged valve 26 is preferably a valve having two center-hinged members 28 that fold towards the muzzle direction when used with a cylindrical launcher barrel 12. With a rectangular cross-section barrel 12, hinged valve 26 may have rectangular members hinged at the sides that fold in the muzzle direction. FIG. 3A shows launcher valve 26 in the closed position, and FIG. 3B shows launcher valve 26 in the open position. In a preferred example, the hinged valve 26 may be controlled by operation of a simple actuator. This could be a combination of a solenoid and a tab. The tab can hold the valve in closed position until released by the solenoid. Actuation of hinged valve 26 may cause rupturing of bladder 14 by interaction between valve 26 and bladder 14.

Before the launch operation in FIG. 3A, with the hinged valve 26 in a closed position, the fill valve 16 may be opened to flow pressurized gas from the pressure vessel 20 to the bladder 14. Pressure inside the bladder 14 increases up to a pre-determined amount, such as a second threshold pressure. The hinged valve 26 and the launcher barrel 12 support the stress in the bladder wall of the bladder 14 maintained at the second threshold pressure.

During a launch operation in FIG. 3B, the hinged valve 26 is opened by rotating the valve gate. The bladder 14 ruptures, resulting in rapid expulsion of the compressed gas accelerating the projectile 18 in the direction B for a high exit velocity of the projectile 18. The hinged valve 26 enables an operator to fill the bladder 14 at a desired rate and to hold launch of the projectile 18 until desired, providing additional operational control for the launcher 10'.

In this way, the disclosed invention reduces the inhibiting effects of flow choking and pressure loss associated with an orifice or other flow-restricting valve. The invention is especially useful for a single-use launch event in which the overall launcher is constrained to be small. To overcome such a constraint and yet produce a projectile launch at high exit velocity, the launcher provides rapidly released, high-pressure gas over a larger area for launch. The bladder material properties may be engineered such that the bladder ruptures at a desired pressure level and breakage pattern. The bladder can be designed to take higher pressures, enabling reduction of pressure vessel size and launcher barrel size, and further improving pressure conditions by minimizing pressure differential over the length of the barrel.

The technical effect of the pressurized gas launcher described in present disclosure is that an exit velocity of a projectile may be increased by reducing the effects of air flow choking and pressure drop.

It will be appreciated that the configurations and routines disclosed herein are exemplary in nature, and that these specific embodiments are not to be considered in a limiting sense, because numerous variations are possible. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A pressurized gas launcher comprising:

a pressure source for providing a quantity of high-pressure gas;

a launcher barrel having a first end and a second end having an opening;

a bladder positioned within said launcher barrel and selectively fluidically coupled to said pressure source, said bladder plastically deforming and rupturing at a predetermined high-pressure gas fill pressure from said pressure source;

a projectile housed within said launcher barrel between said launcher barrel seconded end opening and said bladder, said projectile being dischargeable from said launcher barrel via said opening; and a launch valve positioned in said launcher barrel between said bladder and said projectile, said launch valve having a first position sealing the first end of said launcher barrel from second end, and a second position allowing fluidic communication between said launcher barrel first end and said launcher barrel second end.

2. The apparatus in accordance with claim 1, wherein said launch valve is a hinged valve.

3. The apparatus in accordance with claim 1, wherein said launch valve is a butterfly valve.

4. The apparatus in accordance with claim 1, wherein said launch valve is a gate valve.

5. The apparatus in accordance with claim 1, wherein said launch valve interacts with said bladder to rupture said bladder when said launch valve is moved from the first position to the second position.

6. A pressurized gas launcher for launching a projectile comprising:

a pressure source for providing a quantity of high-pressure gas;

a fill valve joined to said pressure source for selectably controlling fluid flow from said pressure source;

a launcher barrel having a first end and a second end having an opening, said launcher barrel being capable of holding the projectile;

a bladder positioned within said launcher barrel and joined to said fill valve for receiving fluid flow from said pressure source, said bladder plastically deforming and rupturing at a predetermined high-pressure gas fill pressure from said pressure source; and a launch valve positioned in said launcher barrel between said bladder and said launch barrel second end, said launch valve having a first position sealing the first end of said launcher barrel from second end, and a second position allowing fluidic communication between said launcher barrel first end and said launcher barrel second end.

7. The apparatus in accordance with claim 6, wherein said pressure source is a compressor.

8. The apparatus in accordance with claim 6, wherein said pressure source is a compressed gas tank.

9. The apparatus in accordance with claim 6, wherein said launch valve is a hinged valve.

10. The apparatus in accordance with claim 6, wherein said launch valve is a butterfly valve.

11. The apparatus in accordance with claim 6, wherein said launch valve is a gate valve.

12. The apparatus in accordance with claim 6, wherein said launch valve interacts with said bladder to rupture said bladder when said launch valve is moved from the first position to the second position.

* * * * *